US006383012B1

(12) United States Patent
Kisu et al.

(10) Patent No.: US 6,383,012 B1
(45) Date of Patent: May 7, 2002

(54) BRANCHING CONNECTION BOX

(75) Inventors: Naomi Kisu; Tohru Aoki, both of Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/705,719

(22) Filed: Nov. 6, 2000

(30) Foreign Application Priority Data

Nov. 5, 1999 (JP) ..... 11-315966

(51) Int. Cl.[7] ..... H01R 4/26
(52) U.S. Cl. ..... 439/404; 439/417; 439/402
(58) Field of Search ..... 439/404, 402, 439/417, 418, 419, 76.2, 34; 361/794; 174/52.1

(56) References Cited

U.S. PATENT DOCUMENTS 5,727,965 A * 3/1998 Yagi ..... 439/402
5,820,404 A * 10/1998 Chishima et al. ..... 439/417

FOREIGN PATENT DOCUMENTS

JP 7-9022 2/1995 ..... H02G/3/16
JP 8-227738 9/1996 ..... H01R/4/24
JP 9-115572 5/1997 ..... H01R/4/70

* cited by examiner

*Primary Examiner*—Gary Paumen
*Assistant Examiner*—Alexander Gilman
(74) *Attorney, Agent, or Firm*—Sughrue Mion, PLLC

(57) ABSTRACT

In the branching connection box 10, wherein the press-contact terminals 14, 15 on the connection box main body 11 are connected to the electric wires 16, 17, 18 by press-contact, the vertically-connective press-contact terminals 14 that have press-contact parts 14*c*, 14*d* on both vertical sides and the horizontally-connective press-contact terminals 15 that have press-contact parts 15*c*, 15*d* on both vertical sides as well as press-contact parts 15*c*, 15*d* for horizontal linkage connection with such press-contact parts 15*c*, 15*d* as the plural press-contact terminals are used in arbitrary combinations, and the press-contact part 14*c*, 15*c* *on one side of the press-contact terminals* 14, 15 of the two linkage connection types are connected respectively to the ends 16*a* of the wires 16 on the trunk line B side by press-contact and the press-contact part 14*d*, 15*d* on the other side of the press-contact terminals 14, 15 of the two linkage connection types are connected to the other ends 17*b*, 18*b* of the predetermined wires 17, 18 on the branch lines C, D side by press-contact.

5 Claims, 8 Drawing Sheets

BRANCHING CONNECTION BOX

BACKGROUND OF THE INVENTION

1. Technical Field

The present invention relates to the branching connection box in which plural wires that constitute a wire harness, for instance, for automobiles are branched and connected with use of vertically-connective and horizontally-connective press-contact terminals.

2. Related Art

Individual units of the automotive electric equipment are connected with the wire harnesses where a plurality of electric wires are bundled. For the simplification of the wire harness structure or such purposes, the wire harnesses are intervened with branching connection boxes.

FIGS. 10 through 12 show this type of branching connection box that has been disclosed in JP-A-9-115572. As shown in FIGS. 10 and 11, a housing 1 of the branching connection box is composed of a rectangular insulative bottom plate 1*a* and a box-shaped insulative cover 1*b* that covers the insulative bottom plate 1*a*. On both lateral sidewalls of this housing 1, connectors 2 for connection to a plurality of external wires 9 are formed by extrusion as integral parts.

An insulative baseplate 3 is mounted on the insulative bottom plate 1*a* of the housing 1. On the insulative baseplate 3, wires 4 for connection between connectors 2 are wired parallel, and ends of the wires 4 are connected respectively to the prescribed connector 2. A branching connection part 8 is provided on the right-hand side of the insulative baseplate 3 in the fig. The other ends of the wires 4 are arranged in such manner as to oppose mutually at the branching connection part 8 with a predetermined distance apart.

As shown in FIG. 10 through FIG. 12, press-contact terminals 5 are attached to the other end parts of the wires 4 respectively. The press-contact terminals 5 are connected by press-contact and secured respectively to core wires. The core wires are exposed at the other end parts of the wires 4 and are not shown in the Figure. In addition, resin walls 3*a* preventing short circuits are provided on the insulative baseplate 3 and on both sides of each of the press-contact terminals 5.

Each pair of press-contact terminals 5 are connected with an aluminum wire 6 by the wire bonding method, based on a necessary wire connection pattern, and the aluminum wires 6 intersect three-dimensionally in the above-described branching connection part 8. This constitutes a branching circuit inside the housing 1 for branching of a plurality of external wirings 9. In addition, each of the aluminum wires 6 is molded with resin 7 in such manner that some space is left between the aluminum wires 6 on the branching connection part 8 to prevent short circuit.

A similar technology concerning this branching connection box is disclosed in JP-A-7-9022U or such.

However, in the above-described branching connection box, the connectors 2 for connection of the external wires 9 are provided respectively on both sides of the housing, and thus the size of the entire branching connection box has been enlarged by that much. Additionally, since the formation of the branching circuit requires the press-contact terminals 5, which are so disposed as to oppose the branching connection part 8 mutually, to be connected with the aluminum wires 6 and to be covered with the resin 7, the structure has become complicate and the costs have increased.

SUMMARY OF THE INVENTION

Therefore, the invention is purposed to solve the above-described problem through elimination of the connectors for connection to the main body of the connection box, and thus to provide a branching connection box that enables the structural simplification and the cost reduction.

According to the invention, the branching connection box of connecting a plurality of trunk wires on a trunk line side to a plurality of branch wires on a branch line side, the branching connection box includes:

a connection box main body;

at least one vertically-connective press-contact terminal including a pair of first press-contact parts on both vertical sides thereof, one of the first press-contact parts adapted to press-contacting an end of the associated trunk wire, the other first press-contact part adapted to press-contacting an end of the associated branch wire; and at least one horizontally-connective press-contact terminal including a pair of second press-contact parts on both vertical sides thereof and a third press-contact part adapted to connect the second press-contact part to the second contact parts provided at the horizontally adjacent horizontally-connective press-contact terminal, one of the press-contact parts adapted to press-contact an end of the associated trunk wire, the other press-contact part adapted to press-contact an end of the associated branch wire, wherein the at least one vertically-connected press-contact terminal and the at least one horizontally-connective press-contact terminal are arbitrarily combined and mounted on the connection box main body.

In this branching connection box, respective uses of arbitrary combinations of the vertically-connective press-contact terminals and the horizontally-connective press-contact terminals enable formation of desired branching circuits of simple structure at low costs, and elimination of the connectors for connections to the connection box main body also contributes to the entire size reduction.

According to the invention, at least one insulative wall is protruded from an approximate center of the connection box main body and disposed between two of the at least one vertically-connected press-contact terminal and the at least one horizontally-connective press-contact terminal.

This branching connection box enables connection of the ends of the wires on the trunk line side and the other ends of the wires on the branch line side to the press-contact parts on one side and the press-contact parts on the other side of the press-contact terminals of respective linkage connection types by an extremely simple operation of press-contacts, and the elimination of conventional resin molding as a separate operation enables the ensured and inexpensive prevention of a short circuit between the press-contact terminals of the respective linkage connection types with the insulative walls.

DETAILED DESCRIPTION OF PREFERRED EMBODIMENT

An embodiment of the invention is described hereafter, based on the drawings.

Figure 1:
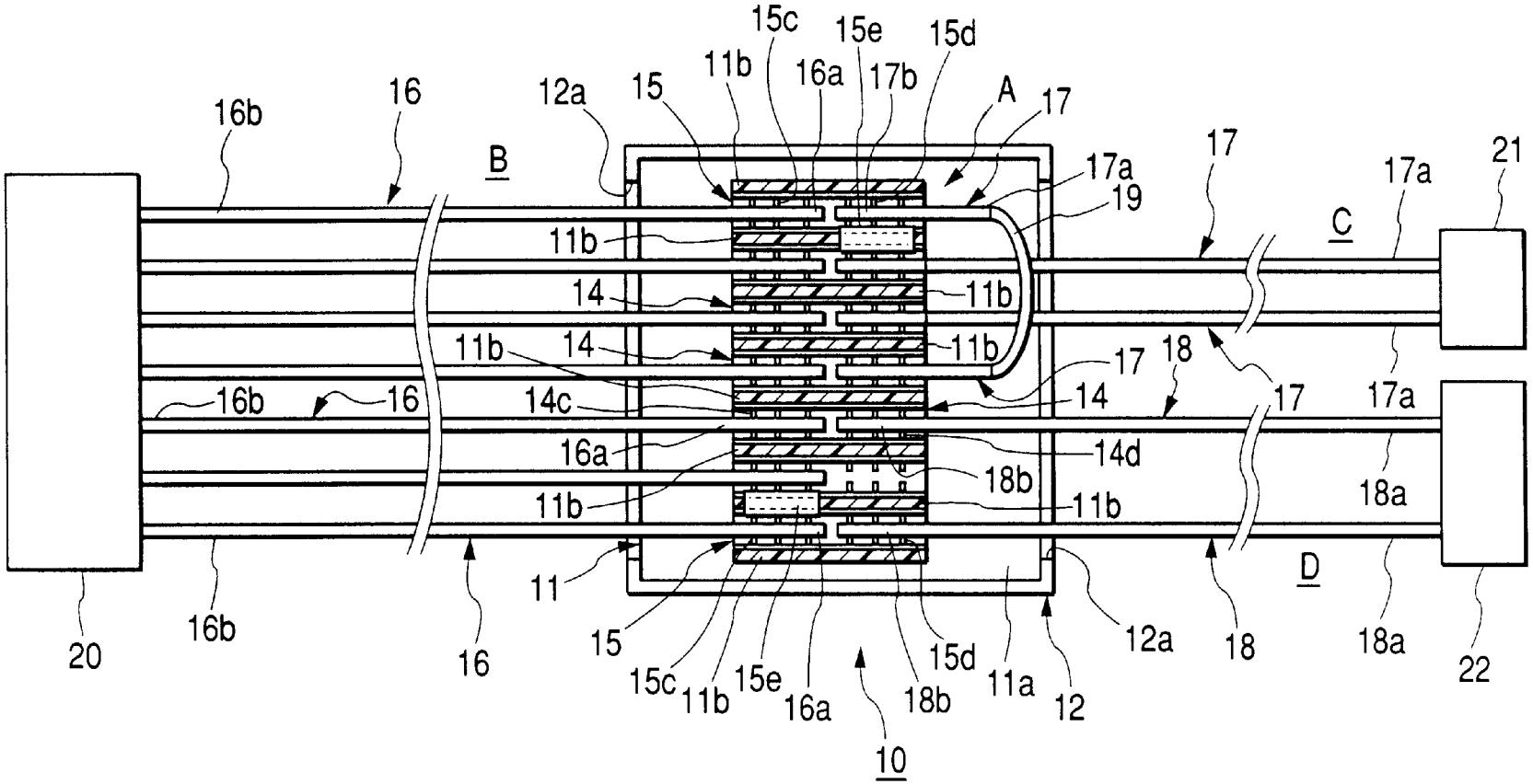
FIG. 1 is a plan that shows a branching connection box as an embodiment of the invention.
Figure 2:
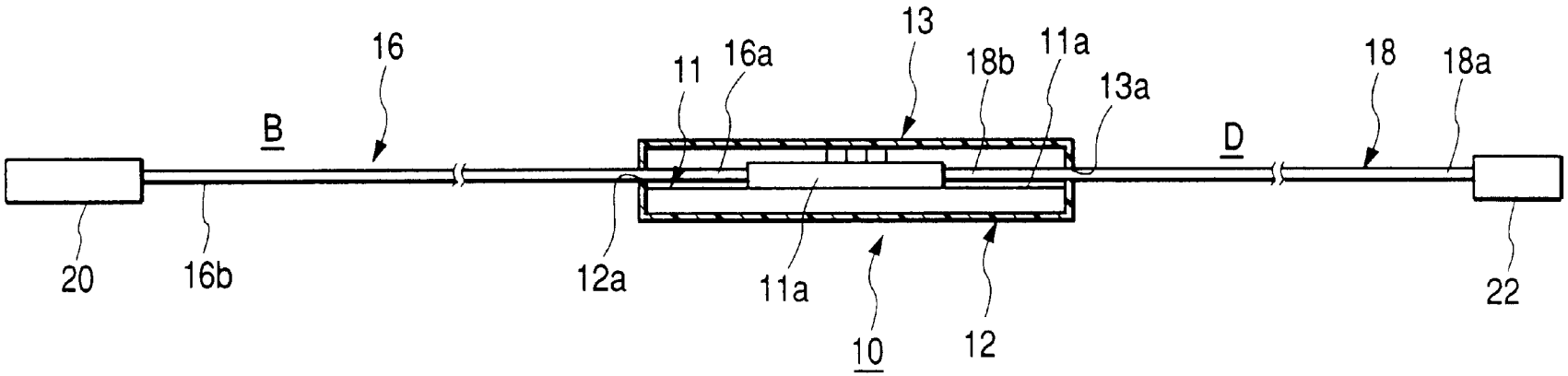
FIG. 2 is a lateral side view of the same branching connection box with a partial section thereof.
Figure 3:
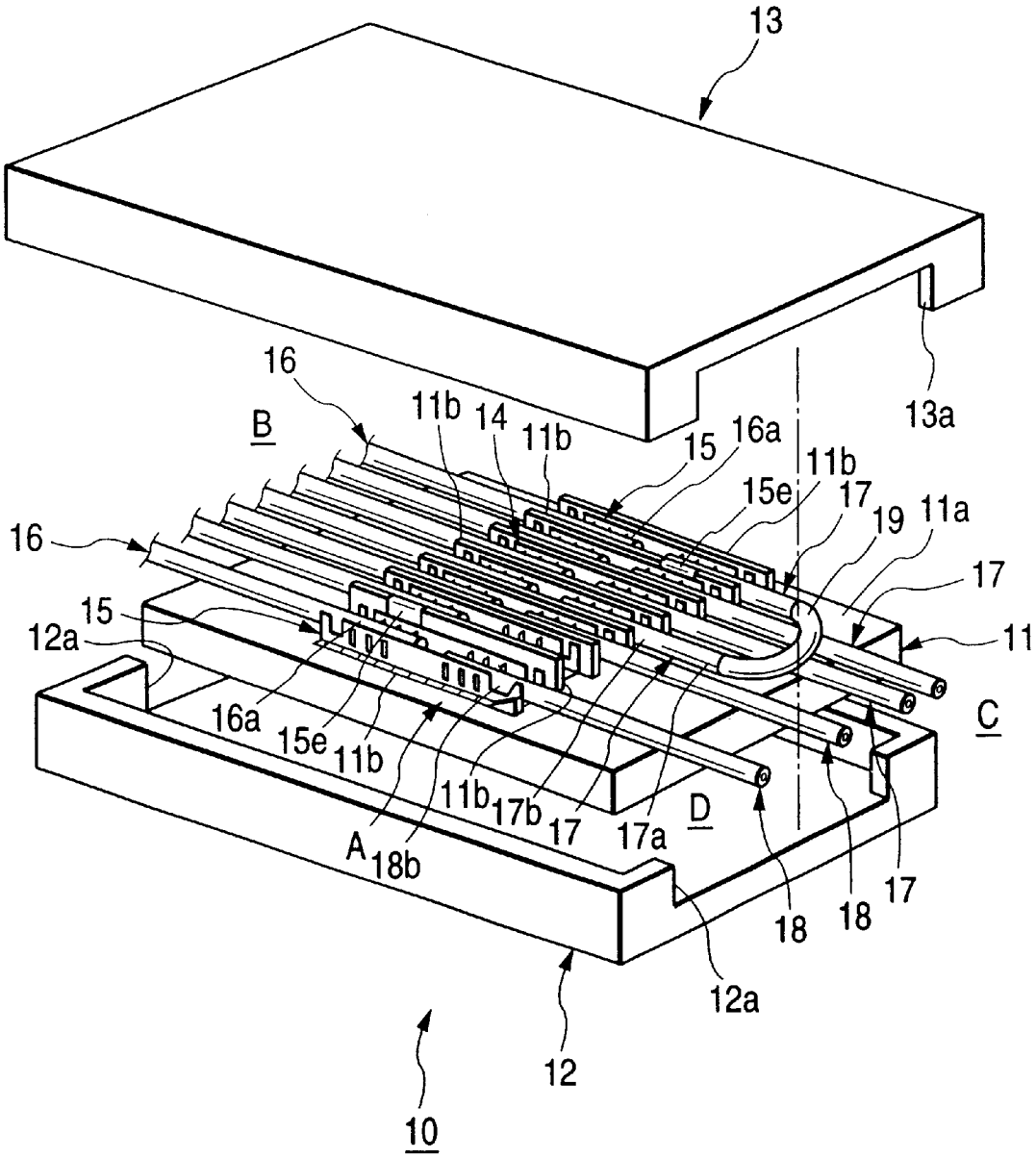
FIG. 3 is a disassembled perspective view of the same branching connection box.
Figure 4:
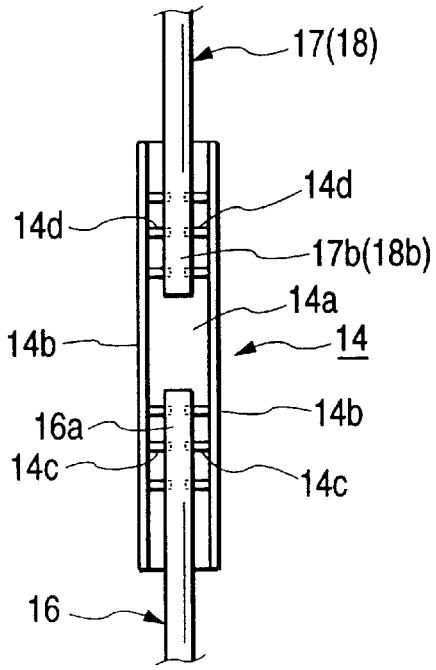
FIG. 4 is a plan that shows a state of electric wire connection by means of the vertically-connective press-contact terminals.
Figure 5:
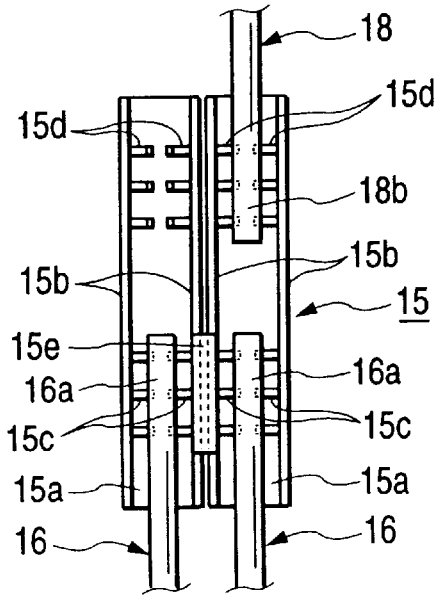
FIG. 5 is a plan that shows a state of electric wire connection by means of the horizontally-connective press-contact terminals.
Figure 6:
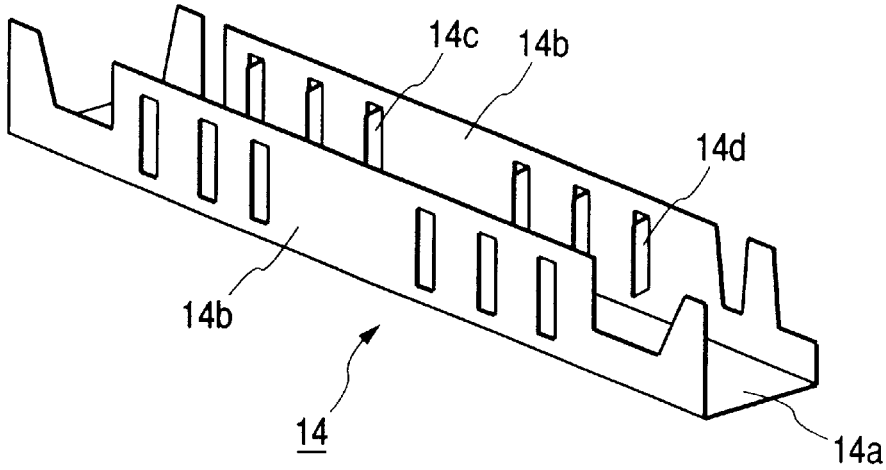
FIG. 6 is a perspective view of the vertically-connective press-contact terminal of the same.
Figure 7:
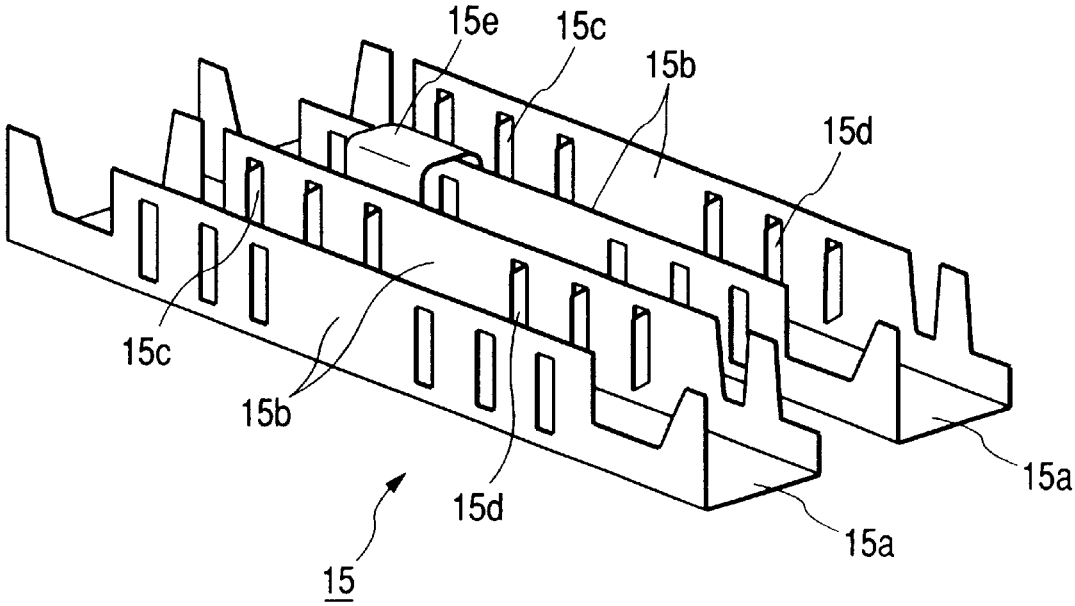
FIG. 7 is a perspective view of the horizontally-connective press-contact terminal of the same.

FIG. 1 is a plan that shows a branching connection box as an embodiment of the invention. FIG. 2 is a lateral side view of the same branching connection box with a partial section thereof. FIG. 3 is a disassembled perspective view of the same branching connection box. FIG. 4 is a plan that shows a state of electric wire connection by way of the vertically-connective press-contact terminals. FIG. 5 is a plan that shows a state of electric wire connection by way of the horizontally-connective press-contact terminals. FIG. 6 is a perspective view of the vertically-connective press-contact terminal of the same. FIG. 7 is a perspective view of the horizontally-connective press-contact terminal of the same.

As shown in FIG. 1 through FIG. 3, a branching connection box 10 includes: a rectangular plate-shaped synthetic-resin connection box main body 11; a synthetic-resin substantially box-shaped lower case 12 that houses the connection box main body 11; a synthetic-resin substantially box-shaped upper case 13 that fits on the lower case 12 and covers the connection box main body 11; and vertically-connective press-contact terminals 14 and horizontally-connective press-contact terminals 15 that are fitted between adjoining insulative walls 11*b* formed in a branching connection position A at an approximate center of an upper surface 11*a* of the above-described connection box main body 11 at prescribed intervals as integral parts by extrusion. The vertically-connective press-contact terminals 14 and the horizontally-connective press-contact terminals 15 are arbitrary combined and form a row, and it can forms desired branching circuits through press-contact connection of ends 16a of the electric wires 16 on the trunk line B side to the other ends 17*b* or 18*b* of either of the electric wires 17 and 18 on the branch lines C and D side. The line truck line B and the branch lines C and D are wired in the branching connection position A in the connection box main body 11. A jumper (relay component) 19 in FIG. 1 and FIG. 3 forms a jump circuit through mutual linkage of ends 17*a* of the electric wires 17 on the both sides on the branch line C side. The other ends 16*b* of the electric wires 16 on the trunk line B side are connected to the connector 20 while the ends 17*a* and 18*a* of the electric wires 17 and 18 on the branch lines C and D side are connected to the connectors 21 and 22.

As shown in FIG. 2 and FIG. 3, openings 12*a* and 13*a* for insertion of the electric wires 16 on the trunk line B side and the electric wires 17 and 18 on the branch lines C and D side are formed at the center parts of the mutually-opposing front and rear walls of the lower case 12 and the upper case 13 and 13*a*. The upper case 13 is locked onto the lower case 12, as shown in FIG. 2, by locking devices (not shown in the fig.) that are provided respectively on both the cases 12 and 13.

As shown in FIG. 4 and FIG. 6, the vertically-connective press-contact terminal 14 has a square-cornered U-shape section defined by a bottom wall part 14*a* and two lateral sidewalls 14*b*. A plurality of press-contact parts 14*c* and 14*d* as pairs of mutually-opposing blades are formed on both sides of the two lateral sidewalls 14*b* (the both sides in vertical directions). As shown in FIG. 1 and FIG. 3, a plurality (three in this embodiment) of vertically-connective press-contact terminals 14 are disposed at the center of branching connection position A of the connection box main body 11. As shown in FIG. 1 and FIG. 4, the ends 16*a* of the electric wires 16 on the trunk line B side are respectively connected by press-contacts to the press-contact parts 14*c* on one side of the vertically-connective press-contact terminal 14. The other ends 17*b* or 18*b* of the prescribed electric wires 17 or 18 on the branch lines C and D side are connected by press-contact to the press-contact parts 14*d* on the other side of the vertically-connective press-contact terminal 14. Therefore, a circuit that is generally-known as through-circuit is formed in this way.

As shown in FIG. 5 and FIG. 7, the horizontally-connective press-contact terminal 15 is a linkage connection of two or more vertically-connective press-contact terminals that have press-contact parts respectively on both sides in vertical directions and that are disposed parallel in a horizontal direction via one or two linkage parts 15*e*. Press-contact parts 15*c* and 15*d* in horizontal directions (on the right and left) are respectively connected to form linkages by the linkage part 15*e*. That is, each of the horizontally-connective press-contact terminals has a square-cornered U-shape section defined by a bottom wall part 15*a* and two lateral sidewalls 15*b*. A plurality of press-contact parts 15*c* and 15*d* including pairs of mutually-opposing blades are formed on both sides of the two lateral sidewalls 15*b* (the both sides in vertical directions). As shown in FIG. 1 and FIG. 3, the horizontally-connective press-contact terminals 15 are disposed respectively on the both sides of the branching connection position A of the connection box main body 11. As shown in FIG. 1 and FIG. 5, the ends 16*a* of the electric wires 16 on the trunk line B side are connected by press-contact to the press-contact parts 15*c* on one side of the horizontally-connective press-contact terminal 15 while the other ends 17*b* or 18*b* of the prescribed electric wires 17 or 18 on the branch lines C and D side are connected by press-contacts to the press-contact part 15*d* on the other side of the horizontally-connective press-contact terminal 15.

In the above-described branching connection box 10 in the embodiment, the press-contact terminals forms the branching circuit by press-contact connection of the electric wires 16 on the trunk line B side and the electric wires 17, 18 on the branch lines C and D side. The vertically-connective press-contact terminal 14 and the horizontally-connective press-contact terminals 14 as the press-contact terminals are respectively used in the arbitrary combinations thereof. Therefore, it can form the simple structure with the desired branching at low costs, since the connector for connections to the connection box main body 11 is eliminated, the entire size of the structure is reduced.

The press-contact terminals 14 and 15 of the both linkage connection types are arranged in the parallel rows and disposed at approximate center of the connection box main body 11 with intervening insulative walls 11*b*. The insulative walls 11*b* are integrally formed on and protruded from the connection box main body 11. Therefore, the ends 16a of the respective wires 16 on the truck line B side are connected to the press-contact parts 14*c* and 15*c*, while the ends 17*b* and 18*b* of the wires 17 and 18 on the truck lines C and D side are connected to the other press-contact 14*d* and 15*d* by the exceedingly simple operation of press-contact. Further, it is unnecessary to conduct conventional resin molding as a separate operation, and the short circuit between the press-contact terminal 14 and 15 is surely and inexpensively prevented by forming the insulative walls 11*b* integrally protruded from the connection box main body 11. This enables reduction of as many circuit-branching relay components on the connection box main body 11 as possible, which also results with the further simplification of the entire structure.

Figure 8:
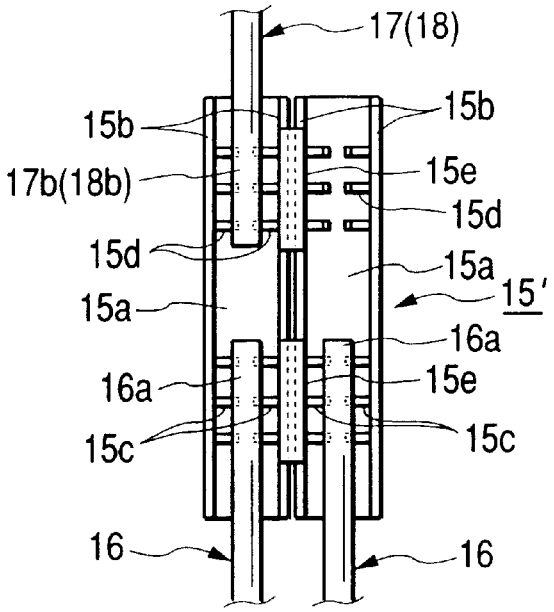
FIG. 8 is a plan that shows a modification in a state of electric wire connection to the horizontally-connective press-contact terminal of the same.
Figure 9:
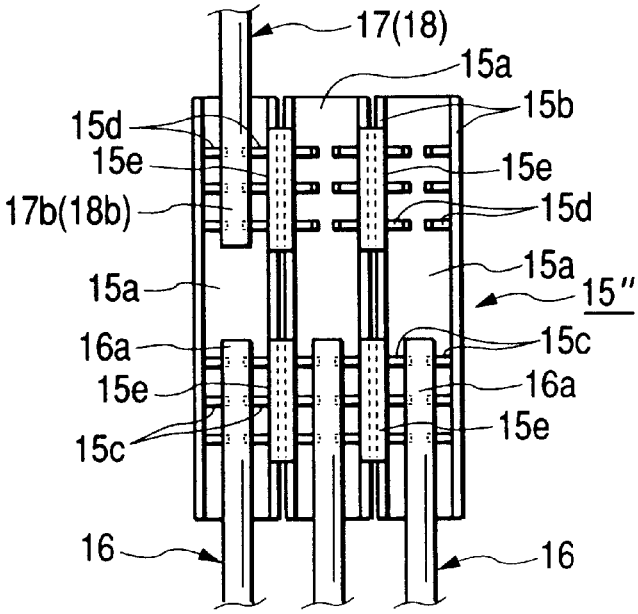
FIG. 9 is a plan that shows another modification in a state of electric wire connection to the horizontally-connective press-contact terminal of the same.
Figure 10:
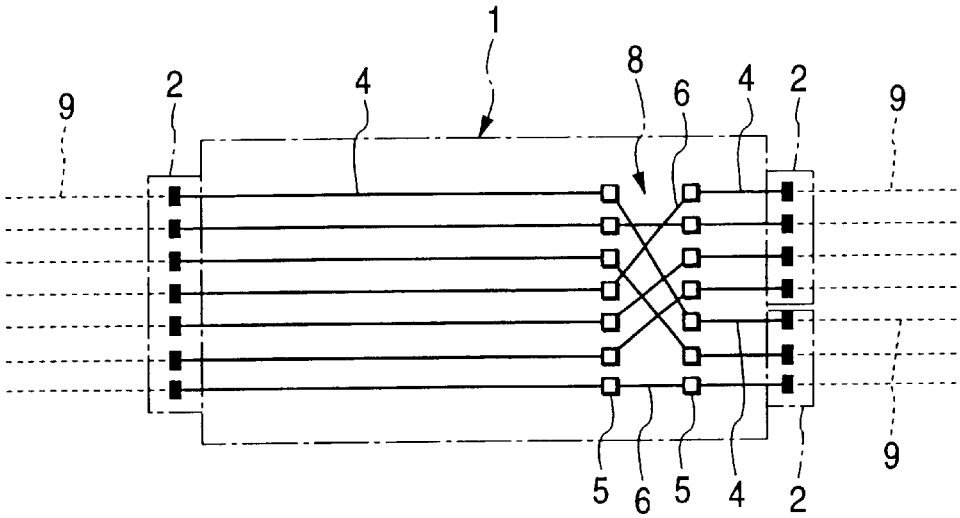
FIG. 10 PRIOR ART
FIG. 10 is a conceptual diagram of the related branching connection box.
Figure 11:
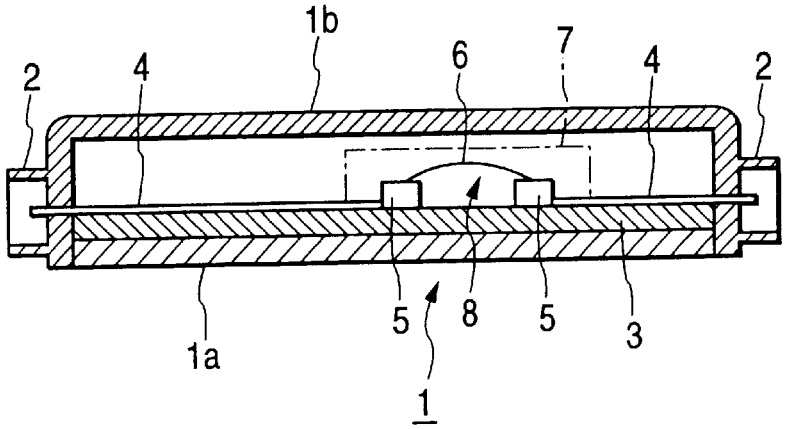
FIG. 11 PRIOR ART
FIG. 11 is a sectional view of the same related branching connection box.
Figure 12:
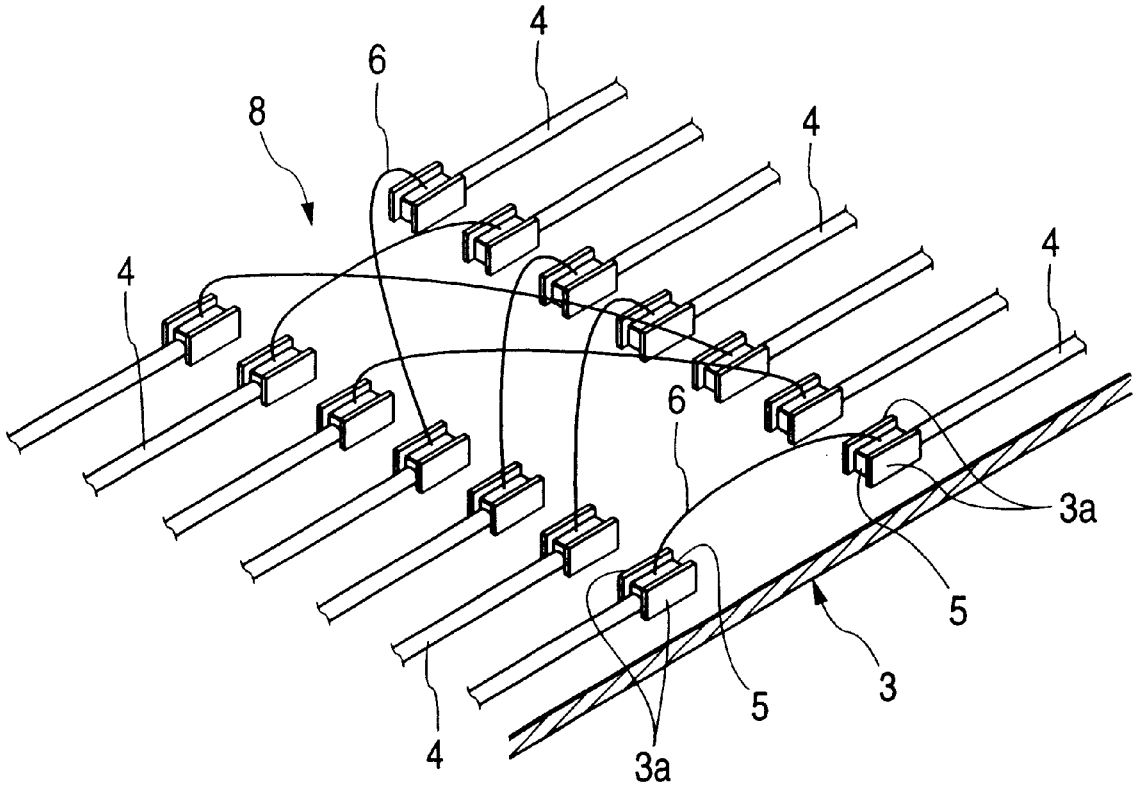
FIG. 12 PRIOR ART
FIG. 12 is a partial perspective view of the same related branching connection box, which shows a connected state of the terminals of the electric wires.

The horizontally-connective press-contact terminal 15 is composed of the two vertically-connective press-contact terminals disposed on the right and left in parallel and connected by linkage at the single linkage part 15*e*. An alternative is a horizontally-connective terminal 15' that is composed by linkage connection with two linkage parts 15*e*, as shown in FIG. 8. Another alternative is a horizontally-connective terminal 15" that is composed of three vertically-connective press-contact terminals on the right and left by linkage connection respectively with two linkage parts 15*e*, as shown in FIG. 9.

As described above, the first aspect of the invention enables the formation of the desired branching circuit in the simple structure at low costs through the respective utilization of arbitrary combinations of the vertically-connective press-contact terminals and the horizontally-connective press-contact terminals as the plural press-contact terminals and also the entire size reduction through the elimination of the connectors for connections to the connection box main body.

The second aspect of the invention enables the connection of the ends of the wires on the trunk line side and the other ends of the wires on the branch line side respectively to the press-contact parts on one side and the press-contact parts on the other side of the press-contact terminals of respective linkage connection types by the extremely simple operation of press-contact with use of the press-contact terminals of the both linkage connection types that are disposed respectively in the parallel rows at the approximate center of the connection box main body, with the intervening insulative walls that are formed integrally on the connection box main body by extrusion, and also the elimination of conventional resin molding as a separate operation, as well as the ensured and inexpensive prevention of the short circuit between the press-contact terminals of the respective linkage connection types with the insulative walls that are formed integrally by extrusion on the connection box main body.

What is claimed is:

1. A branching connection box for connecting a plurality of trunk wires on a trunk line side to a plurality of branch wires on a branch line side, said branching connection box comprising:

a connection box main body;

at least one vertically-connective press-contact terminal including, at least two vertical side portions;

a pair of first press-contact parts, each one of said pair of said first press-contact parts includes oppositely facing protrusions respectively formed on said vertical side portions, one of said pair of said first press-contact parts is, adapted to press-contact an end of one of said trunk wires, the other of said first press-contact parts is adapted to press-contact an end of one of said branch wires; and at least one horizontally-connective press-contact terminal unit including, two or more horizontally adjacent connective press-contact terminals, each of said horizontally adjacent connective press-contact terminals respectively have at least two vertical side portions and each of said horizontally adjacent connective press-contact terminals respectively include a pair of second press-contact parts, each one of said pair of said second press-contact parts includes oppositely facing protrusions respectively formed on said vertical side portions of said horizontally adjacent connective press-contact terminals, at least one of said pair of said second press-contact parts of one of said horizontally adjacent connective press-contact terminals is adapted to press-contact an end of one of said trunk wires, the other of said pair of said: second press-contact parts of a same said one of said horizontally adjacent connective press-contact terminals is adapted to press-contact an end of one of said branch wires; and a first linkage part adapted to connect one of said pair of said second press contact parts of one of said horizontally adjacent connective press-contact terminals to a corresponding one of the other of said pair of said second press contact parts of the other one of said horizontally adjacent connective press-contact terminals, wherein said at least one vertically-connected press-contact terminal and said at least one horizontally-connective press-contact terminal unit form a row and are mounted on said connection box main body.

2. A branching connection box according to claim 1, wherein at least one insulative wall is disposed between said at least one vertically-connected press-contact terminal and said at least one horizontally-connective press-contact terminal unit.

3. A branching connection box according to claim 1 further comprising a jumper connected to said at least one first press-contact part and said at least one second press-contact part.

4. A branching connection box according to claim 1, wherein a plurality of vertically-connective press-contact terminals are provided and are separated by an insulative wall.

5. A branching connection box according to claim 1, further comprising a second linkage part adapted to connect a one of said pair of said second press contact parts which was not connected to said first linkage part, to a corresponding one of said pair of said second press contact parts of- the other one of said horizontally adjacent connective press-contact terminals, which was not connected by said first linkage part.

* * * * *